US008651833B2

(12) United States Patent
Heaps et al.

(10) Patent No.: US 8,651,833 B2
(45) Date of Patent: Feb. 18, 2014

(54) COMBINED GAS AND LIQUID PUMP

(75) Inventors: David Heaps, Haworth (GB); John Hegarty, Wakefield (GB)

(73) Assignee: Wabco Automotive UK Limited, Morley, Leeds (GB)

( * ) Notice: Subject to any disclaimer, the term of this patent is extended or adjusted under 35 U.S.C. 154(b) by 728 days.

(21) Appl. No.: 12/295,704

(22) PCT Filed: Jun. 5, 2007

(86) PCT No.: PCT/GB2007/002060

§ 371 (c)(1),
(2), (4) Date: Aug. 25, 2009

(87) PCT Pub. No.: WO2007/141511

PCT Pub. Date: Dec. 13, 2007

(65) Prior Publication Data

US 2010/0000207 A1 Jan. 7, 2010

(30) Foreign Application Priority Data

Jun. 5, 2006 (GB) ..... 0611044.9

(51) Int. Cl.

| | |
|---|---|
| ***F04B 17/00*** | (2006.01) |
| ***F04B 35/04*** | (2006.01) |
| ***F16N 13/20*** | (2006.01) |
| ***F04C 2/00*** | (2006.01) |

(52) U.S. Cl.

USPC ..... 417/410.3; 418/15; 418/255; 418/254

(58) Field of Classification Search

USPC ..... 417/201, 410.3, 437; 60/397, 605.1, 60/605.2, 605.3; 418/15, 253, 254, 255, 418/146; 184/6.13

See application file for complete search history.

(56) References Cited

U.S. PATENT DOCUMENTS 3,740,170 A * 6/1973 Miller ..... 417/407
4,009,972 A * 3/1977 Sarle ..... 417/407

(Continued)

FOREIGN PATENT DOCUMENTS

GB 1027587 4/1966
GB 1088959 10/1967

(Continued)

OTHER PUBLICATIONS

International Search Report issued Aug. 21, 2007, in International Application No. PCT/GB2007/002060 filed on Jun. 2007.

(Continued)

*Primary Examiner* — Charles Freay
*Assistant Examiner* — Alexander Comley
(74) *Attorney, Agent, or Firm* — Downs Rachlin Martin PLLC

(57) ABSTRACT

The present invention provides a combined gas and liquid pump (46) for an internal combustion engine (10). The pump (46) includes a casing (58) having a cavity (60) containing a rotor (62) and a vane (64) slidably mounted to the rotor (62), wherein the cavity (60) is provided with an inlet (50) connectable to a gas source, a further inlet (48) connectable to a liquid source which is separate to the gas source, and an outlet (56). The rotor (62) and vane (64) are movable to draw liquid and gas into the cavity (60) through the respective inlets (50,48) and to move said liquid and gas out of the cavity (60) through the outlet (56). The inlets (50,48) are arranged through the casing (58) such that fluid is drawn first through one of the inlets and then through the other of the inlets before being discharged through the outlet (56).

18 Claims, 3 Drawing Sheets

(56) References Cited

U.S. PATENT DOCUMENTS

| | | | | |
|---|---|---|---|---|
| 4,142,608 | A * | 3/1979 | Sarle | 184/6.11 |
| 4,752,193 | A * | 6/1988 | Horler | 417/407 |
| 4,926,641 | A * | 5/1990 | Keller | 60/605.3 |
| 5,239,972 | A * | 8/1993 | Takeyama et al. | 123/573 |
| 6,394,078 | B1 * | 5/2002 | Kling | 123/572 |
| 2005/0100455 | A1 * | 5/2005 | Tuddenham | 417/410.3 |
| 2005/0129528 | A1 * | 6/2005 | Hunter et al. | 417/199.1 |
| 2005/0180865 | A1 * | 8/2005 | Heaps et al. | 417/410.3 |

FOREIGN PATENT DOCUMENTS

| | | |
|---|---|---|
| GB | 1504839 | 3/1978 |
| GB | 2058926 | 4/1981 |
| GB | 2242708 | 10/1991 |
| GB | 2363168 | 12/2001 |
| GB | 2416812 | 2/2006 |
| JP | 59208192 | 11/1984 |
| JP | 3-017298 | 2/1991 |
| JP | 3074508 A | 3/1991 |
| JP | 09158879 | 6/1997 |
| JP | 2000186684 | 7/2000 |

OTHER PUBLICATIONS

UK Patent Office Search Report issued Oct. 5, 2006, in United Kingdom Application No. 0611044.9 filed on Jun. 5, 2006.

International Preliminary Report on Patentability dated Dec. 24, 2008 in International Application No. PCT/GB2007/002060.

* cited by examiner

COMBINED GAS AND LIQUID PUMP

The present invention relates to a multiple inlet pump suitable for use with an engine. In particular, though not exclusively, the present invention relates to a combined gas and liquid pump. More particularly, though still by no means exclusively, the present invention relates to a combined oil scavenge and vacuum pump for the engine of a road vehicle.

A typical vehicle engine includes a lubrication system which is arranged to circulate oil from a reservoir through and/or over internal components of the engine and back to the sump. Such a system typically includes a pump to supply filtered oil from the sump, while the return flow of oil to the sump is typically achieved by gravity induced flow. Where the engine is of the dry sump type, i.e. it does not have a sump at the bottom of the engine below the engine crankshaft but a remote reservoir, then at least one scavenge pump is required to return the oil to the reservoir The height of certain portions of an engine relative to the engine sump or, in the case of a dry sump engine, the catchment tank may hinder the draining of oil from due to the lack of a sufficient gradient in the conduit path leading to the sump or tank. Additionally, operating characteristics of the vehicle or external environmental factors may affect the flow of oil to a sump or catchment tank. Examples of such circumstances are increased oil viscosity at low temperatures and forces experienced by the oil during cornering of the vehicle.

A similar scavenge pump requirement can exist where the engine is provided with an exhaust gas turbocharger. Exhaust gas turbochargers which are used in conjunction with the engines of automotive vehicles require a supply of oil in order to lubricate the bearings of the shaft to which the turbocharger compressor wheel and rotor are connected, and to cool the turbocharger by removing heat therefrom. The turbocharger housing is typically provided with an inlet connection to permit the supply of filtered engine oil thereto. The housing is further typically provided with an outlet connection to permit the oil to drain from the housing to the engine sump or a remote catchment tank. As before, a lack of height between the housing and sump or tank can necessitate the use of a scavenge pump, as can vehicle operating conditions and external environmental factors.

The requirement to provide one or more scavenge problems can create problems with regard to how and where the or each pump is to be mounted and driven. It is therefore highly desirable to reduce to a minimum the number of scavenge pumps or, more preferably, to eliminate their need entirely.

According to a first aspect of the present invention there is provided a multiple inlet pump for an engine, the pump including a casing having a cavity containing a movable assembly, wherein the cavity is provided with a first inlet connectable to a first fluid source, a further inlet connectable to further fluid source which is separate to the first fluid source, and an outlet, the movable assembly being movable to draw fluid into the cavity through the inlets and to move said fluid out of the cavity through the outlet, wherein the inlets are arranged through the casing such that fluid is drawn first through one of the inlets and then through the other of the inlets before being discharged through the outlet.

The present invention thus provides a single pump that is able to draw fluid from multiple sources in and around the engine and thus obviates the need for multiple pumps to be provided.

The inlets may each be connectable to an air source, a liquid source or a combined air and liquid source. For example, one of the inlets may, in use be connectable to an air source and the other of the inlets connectable to a liquid source. In such an embodiment, the air source may be defined by the air reservoir of a brake booster of the vehicle, while the liquid source may be defined by an oil source of or associated with the engine.

One or both of the inlets may be provided with a non-return valve operable to prevent the flow of fluid into the cavity when the pump is not operating, and to prevent the flow of the fluid out of the cavity through one or both inlets during certain operating conditions of the pump.

Where the pump is connected to an air source and a liquid source, the inlets may be arranged on the casing such that fluid is first drawn through the inlet connected to the air source before fluid is then drawn through the inlet connected to the liquid source. Alternatively, the inlets may be arranged on the casing such that fluid is first drawn through the inlet connected to the liquid source before fluid is then drawn through the inlet connected to the air source.

The movable assembly of the pump may be rotatable relative to the casing. In such an embodiment, the movable assembly may comprise a rotor and a vane slidably mounted to the rotor. The rotor may be provided with a plurality of slidably mounted vanes. In such an embodiment, the cavity has a substantially cylindrical configuration and is defined by a substantially continuous edge wall and opposed end walls. The edge wall and one of the end walls may be defined by the casing, and the other of the end walls defined by a plate fittable to the casing. In such an embodiment, the rotor is mounted in an end wall of the cavity and is offset relative to the notional centre of the cavity.

Where a non-return valve provided with an inlet connectable to an air source, the valve may be arranged to close when the pump is not operating and remain closed when the pump is operated in a reverse direction. This inlet non-return valve may act to maintain a reduction in pressure induced by operation of the pump in a conduit upstream of the pump inlet. The inlet non-return valve may further act, in use, to prevent the flow of liquid out of the cavity through the inlet. The inlet non-return valve may be housed in a conduit member which is fitted to the pump casing and which conduit member is in fluid communication with the cavity inlet. The inlet non-return valve preferably includes a movable valve member which is movable between an open position and a closed position. The inlet non-return valve preferably also includes a resilient means operable to urge the valve member to the closed position when the pump ceases operation. The resilient means may comprise a separate resilient member such as a spring. Alternatively, the resilient means may comprise a resilient portion of the valve member.

The inlet connectable to the liquid source may also be provided with a non-return valve. The non-return may have similar features to that described with reference to the non-return valve provided for the inlet connectable to the air source. The liquid source inlet non-return valve prevents liquid draining into the cavity when the pump is not operating. The non-return valve also, in use, prevents air within the chamber from being vented through the inlet.

The pump may be provided with more than two inlets arranged to draw air, liquid or a combination of air and liquid from a number of separate sources.

According to a second aspect of the present invention there is provided a vehicle having an engine including an exhaust gas turbocharger and a vacuum operated brake booster arrangement, the engine having a common pump to scavenge oil from the turbocharger and to supply a vacuum to the brake booster arrangement, wherein the pump includes a casing having a cavity containing a movable assembly, and wherein further the cavity is provided with an inlet connectable to the lubrication system of the turbocharger, a further inlet connectable to a vehicle braking arrangement, and an outlet, the movable assembly being movable to draw fluid into the cavity through the inlets and out of the cavity through the outlet, wherein the inlets are arranged through the casing such that fluid is drawn first through one of the inlets and then through the other of the inlets before being discharged through the outlet.

Features of the pump of the second aspect described with reference to the first aspect are equally applicable.

According to a third aspect of the present invention there is provided a method of scavenging oil from the lubrication system of a turbocharger of a vehicle and supplying a vacuum to a brake booster arrangement of the vehicle with a common pump, the method comprising the steps of:

providing a vehicle having an exhaust gas turbo charger and a vacuum operated brake booster arrangement, providing a pump drivable by the engine of the vehicle, the pump including a casing having a cavity containing a rotor and a vane slidably mounted to the rotor, and wherein the cavity is provided with an inlet connectable to the lubrication system of the turbocharger, a further inlet connectable to a vehicle braking arrangement, and an outlet, and moving the rotor and vane within the cavity to draw oil and air into the cavity through the respective inlets and out of the cavity through the outlet, the inlets are arranged through the casing such that fluid is drawn first through one of the inlets and then through the other of the inlets before being discharged through the outlet.

An embodiment of the present invention will now be described with reference to the accompanying drawings in which.

Figure 1:
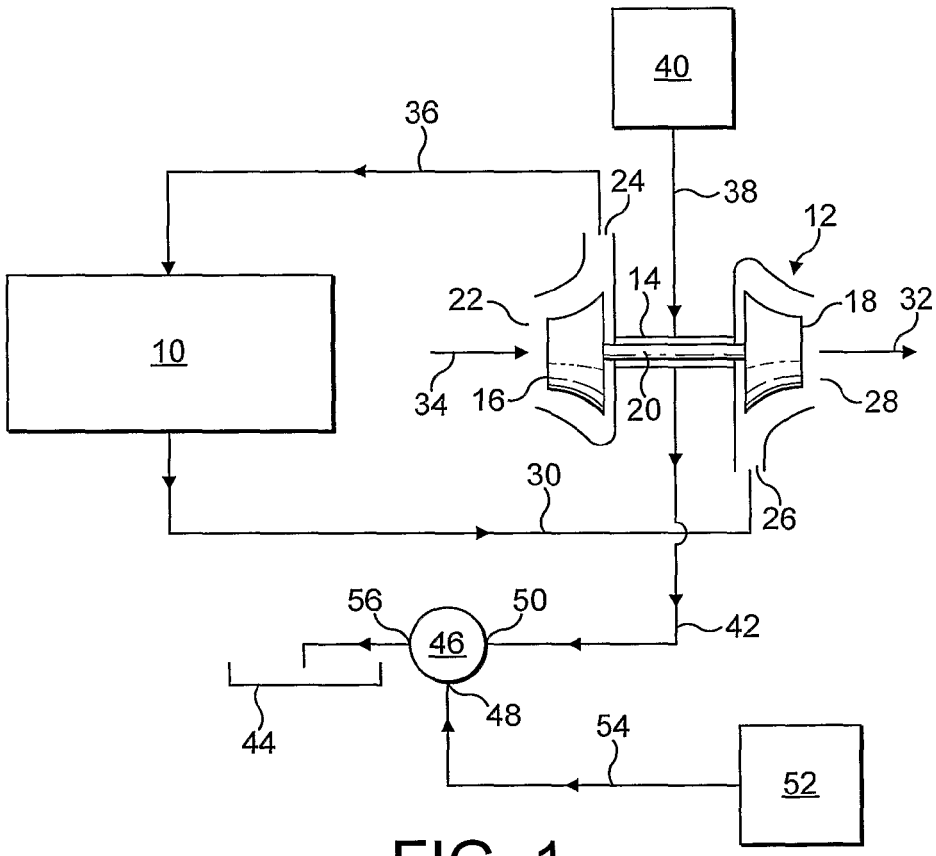
FIG. 1 shows a schematic representation of an engine and turbocharger arrangement having a pump according to the present invention.

Referring firstly to FIG. 1, there is shown an engine generally designated 10 having an exhaust gas turbocharger generally designated 12. The turbocharger 12 includes a housing 14 within which there is provided a compressor wheel 16, a rotor 18 and a shaft 20. The housing 14 is further provided on the compressor side with an inlet 22 for ambient air and an outlet 24 for supplying compressed air to the engine 10. On the rotor side, the housing 14 is provided with an inlet 26 for receiving exhaust gas from the exhaust manifold of the engine 10 and an outlet 28 in communication with an exhaust pipe or conduit. The turbocharger 12 is operable in a conventional manner whereby the rotor 18 is caused to rotate by the flow of exhaust gas thereacross as indicated by arrows 30 and 32. Rotation of the rotor 18 causes rotation of the shaft 20 which, in turn, causes rotation of the compressor wheel 16. Rotation of the compressor wheel 16 causes ambient air to be drawn into the housing (indicated by arrow 34), compressed, and supplied to the inlet manifold of the engine 10 as indicated by arrow 36.

The shaft 20 connecting the compressor wheel and rotor 16,18 is mounted in bearings (not shown) of the housing 14. The bearings require a supply of oil to prevent them from being damaged during use. The housing 14 is thus provided with an inlet connection, illustrated schematically by arrow 38, to a source of clean oil 40. The clean oil is typically filtered engine oil and is supplied to the housing by an oil pump (not shown) of the engine 10. The housing 14 is further provided with an outlet connection, illustrated schematically by arrow 42, to permit oil to drain from the housing 14 to a sump 44. Between the sump 44 and the housing 14 there is provided a pump 46. The pump 46 is operable to draw oil from the housing 14 and supply it to the sump 44. The pump 46 is provided with a first inlet 50 to which the outlet of the housing 14 is connected and a second inlet 48 which is connected to braking system 52 of the vehicle. The pump 46 is thus operable to both draw oil from the turbocharger housing 14 and to provide a vacuum (indicated by arrow 54) to boost the braking performance of the vehicle to which the engine 10 and turbocharger 12 are fitted. In the embodiment shown, the pump 46 is provided with a single outlet 56.

Figure 2:
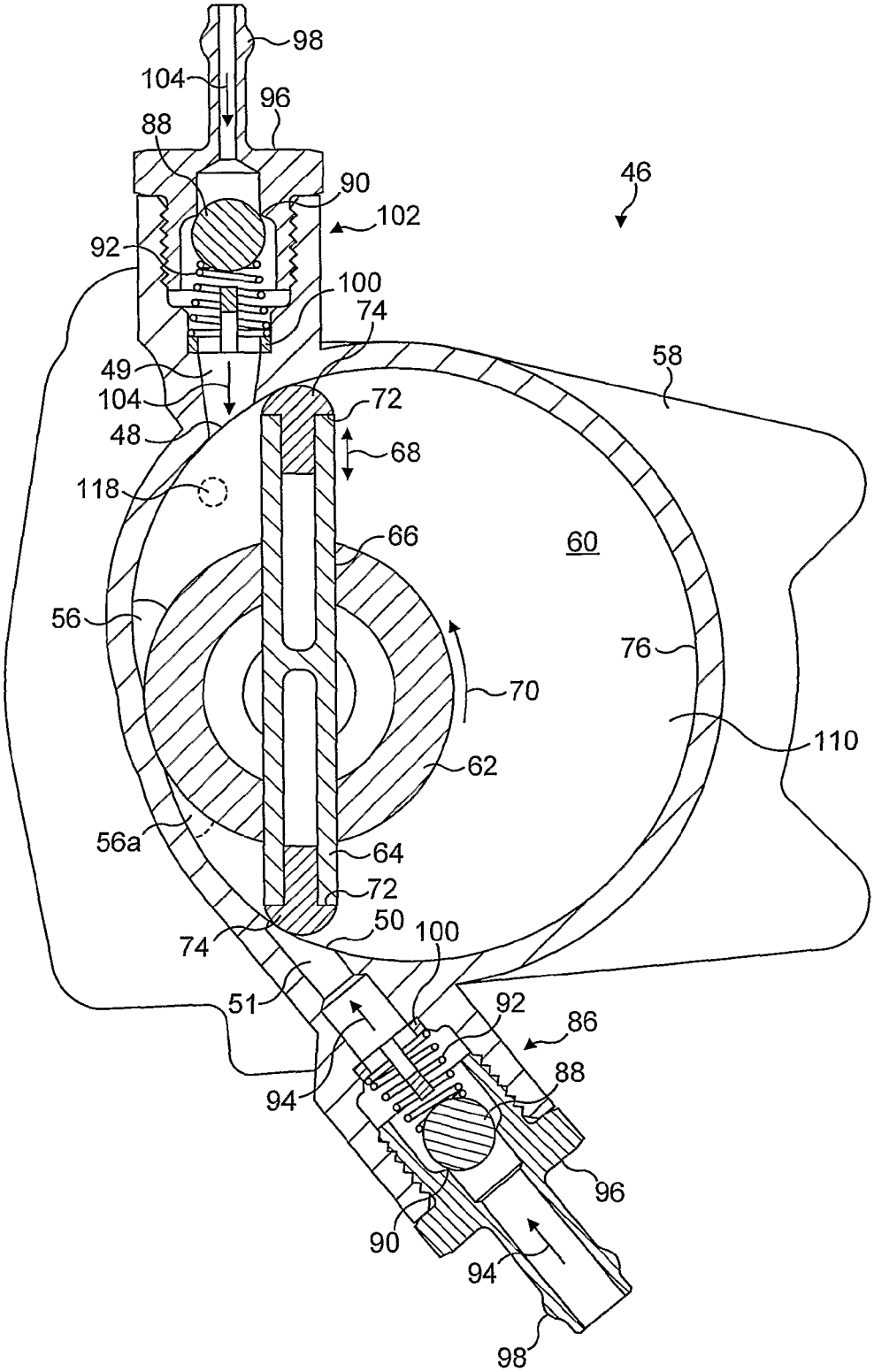
FIG. 2 shows a first cross-sectional view of the pump.
Figure 3:
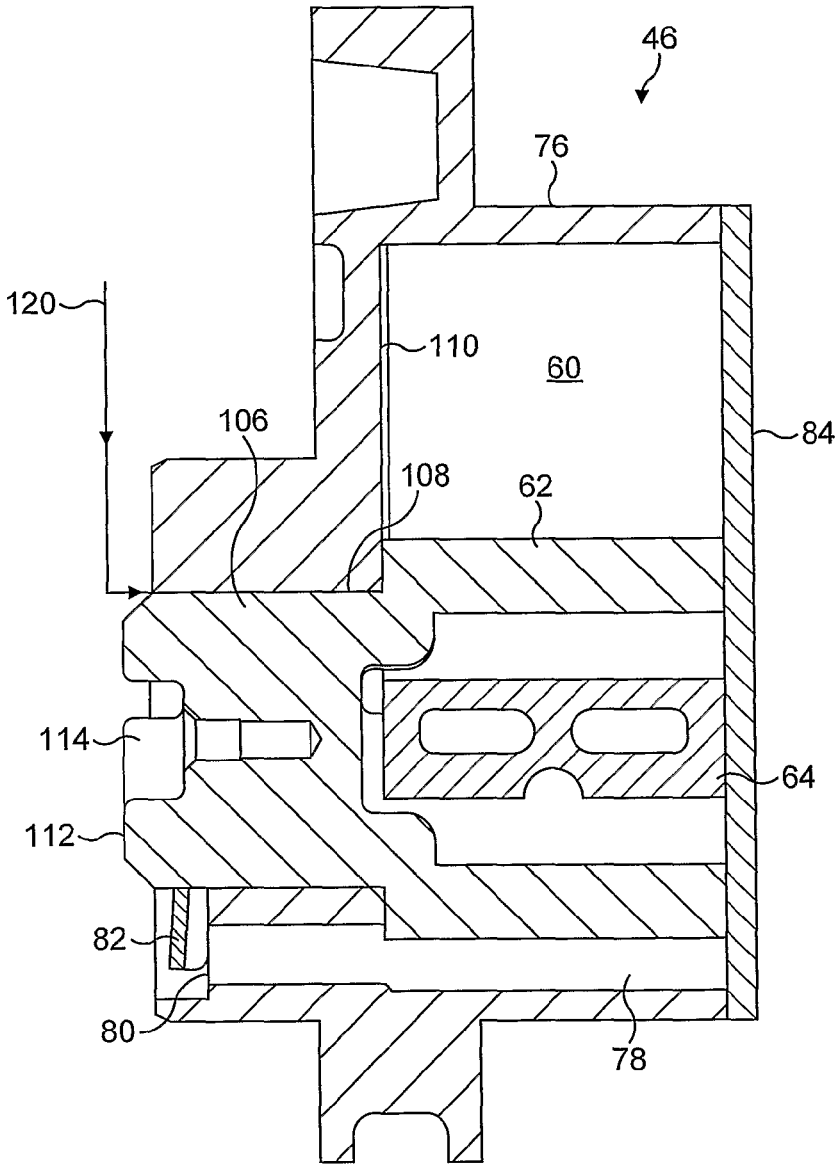
FIG. 3 shows a second cross-sectional view of the pump.

Referring now to FIGS. 2 and 3 there is shown a pump 46 having a configuration suitable for use in the engine and turbocharger system described with reference to FIG. 1. The pump 46 includes a casing 58 within which there is defined a cavity 60. Within the cavity 60 there is provided a rotor 62 and a vane 64. The vane 64 is slidably mounted in a slot 66 of the rotor 62 and is slidably movable relative to the rotor 62 as indicated by arrows 68. The rotor 62 is rotatable relative to the casing 58 as indicated by arrow 70. The ends 72 of the vane 64 are provided with seals 74 which ensure that a substantially fluid tight seal is maintained between the vane 64 and the wall 76 of the cavity 60 as the vane 64 is rotated by the rotor 62.

The cavity 60 is provided with a first inlet 50, a second inlet 48 and an outlet 56. As described above, the second inlet 48 is in fluid communication with a second inlet conduit 49 formed in the casing 58 which in turn is connected to an oil outlet of the turbocharger housing. The first inlet 50 is in fluid communication with a first inlet conduit 51 formed in the casing 58 which in turn is connected to a brake booster arrangement of the engine. The outlet 56, is in fluid communication with an outlet conduit 78 extending through the casing 58 to the exterior thereof into a sump. At the end of the conduit 78 remote from the cavity outlet 56 there is provided a reed valve 80 and a stop 82 which constrains the amount by which the reed valve 80 can open. The reed valve 80 prevents sump air and/or unfiltered oil from being drawn into the cavity 58 when operation of the pump 46 ceases. The cavity 60 is closed by a plate 84 attached to the casing 12 by threaded fasteners (not shown).

In the embodiment shown, the pump 46 is provided with a single outlet 56. Optionally, the pump 46 may be provided with a secondary outlet indicated by broken line 56*a*. The secondary outlet is provided on the opposite side of the rotor 62 to the first outlet 56. The secondary outlet 56*a* may be provided to prevent trapped fluids from damaging the pump 46 where the pump 46 is required, in certain circumstances, to move in a reverse direction. The secondary outlet 56*a*, where fitted, may be provided with a separate conduit through the casing, together with a reed valve and stop arrangement. The pump 46 may also be provided with one or more additional outlets, which is to say additional to the single outlet 56 hereinbefore described, where packaging or space constraints apply.

The first inlet conduit 51 is provided with a non-return valve generally designated 86. The non-return valve 86 comprises a spherical valve member 88 which is urged against a seat 90 by a spring 92. The strength of the spring 92 is such that flow through the conduit 51 (indicated by arrow 94) to the inlet 50 induced by the rotation of the rotor 62 and vane 64 causes the spring 92 to compress and the valve member 88 to move from its seat 90. Upon cessation of this flow 94 the valve member 88 is urged back against its seat 90 thereby closing the conduit 51. In the embodiment shown the non-return valve 86 is partially received in a hollow tubular insert 96 which is fitted to the inlet conduit 51. The insert 96 includes a tubular connector portion 98 which, in use, permits the connection of a tube or line extending from a brake booster arrangement. The insert 96 includes the valve seat 90, while the spring 92 is mounted on a carrier 100 which is fitted to the conduit 51. The carrier 100 further serves to limit the movement of the valve member 88 away from the seat 90.

The second inlet conduit 49 is fitted with a similar non-return valve generally designated 102. Features common to the valve 86 described with reference to the first inlet conduit 51 are identified with like reference numerals. It will be noted that the tubular connector portion 98 of the second inlet conduit insert 96 has a narrower bore that that of the connector portion of first inlet conduit insert 96. The narrow bore is provided to restrict the flow of fluid through the second inlet 48. It will be appreciated, however, that the second inlet conduit insert 96 may have a bore size substantially the same as that of the first inlet conduit insert 96, with the restriction being provided outside of the pump 46 and between the pump 46 and the turbocharger 12. As before, the spring 92 and valve member 88 permit the flow of fluid through the second inlet conduit 49 as indicated by arrow 104. The non-return valve 102 furthermore prevents the flow of fluid in the opposite direction as an end 72 of the vane 64 moves around the wall 76 of the cavity 60 after passing the second inlet 48 and before the second inlet 48 is subsequently passed by the opposing end 72 of the vane 64.

When connector 98 is connected to a brake booster it is, in effect connected to a relatively small air reservoir As the pump rotates, air is gradually removed from the reservoir which gradually reduces the maximum air pressure inside cavity 60 with each rotation. When the pressure in cavity 60 is low enough, valve 102 opens allowing fluid indicated by arrow 104 into cavity 60. As the vane turns further, the air pressure inside cavity 60 increases (as the available volume of space starts to decrease) until just above atmospheric pressure when the reed valve opens to allow venting. Between these two events, the increase in cavity pressure causes valve 102 to close so sealing this line against the air being compressed in cavity 60.

To ensure that the second inlet 48 is able to suck fluids under all conditions, the volume of space for fluids created by the internal pump arrangement must exceed the volume of fluids being supplied through the first inlet 50. Thus for a given set of pump performance conditions, the volume of air entering the cavity 60 through the first inlet 50 may have to be restricted.

It will be appreciated that the other forms and configurations of non-return valve may be employed.

The rotor 62 is provided with a shaft portion 106 which extends through an aperture 108 provided in a rear face 110 of the cavity 60 such that the distal end 112 of the shaft portion 106 projects from the casing 58. The shaft portion 106 is provided with a drive coupling feature 114 which, in use, enables the rotor 16 to be connected to a drive member (not shown). In the embodiment shown, the coupling feature 114 is in the form of a slot. It will be appreciated that other forms of coupling feature may be utilised. The interface between the shaft portion 106 and the casing aperture 108 is lubricated by an oil feed line indicated by arrow 120 on FIG. 3. The oil feed line 120 supplies oil, preferably filtered engine oil, to the pump 46. The oil is utilised firstly to lubricate the rotation of the shaft portion 106 in the casing aperture 108. The oil subsequently passes to the cavity 60 whereupon it lubricates other moving parts including the movement of the vane 64 relative to the rotor 62 and the vane ends 72 relative to the wall 76.

It will thus be appreciated that the moving parts of the pump 46 is not lubricated solely by oil passing through the pump 46 from one of the cavity inlets 48,50. Accordingly, the pump 46 is able to continue to run when oil is not being drawn through the first inlet 48. The oil which is fed to the shaft portion 106 and which then enters the cavity 60 between the shaft portion 106 and the aperture 108 combines with oil entering the cavity 60 via the inlets 48,50 and is subsequently ejected through the outlet 56.

In use, the rotor 62 and vane 64 are rotated to draw fluid through the inlets 48, 50 and to expel said fluid through the outlet 56. The position of the inlets 48, 50 is such that fluid, typically air, is first drawn through the first inlet 50 from the brake booster arrangement before fluid, predominantly oil, is drawn through the second inlet 48 from the turbocharger housing. The fluids are ejected together through the outlet 56. The inlets 48,50 are arranged through the casing 60 such that the first inlet 50 closes before fluid is drawn through the second inlet 48. It will be appreciated that the second inlet 48, its conduit 49 and non-return valve 102 may be provided in alternative positions in the casing 60. The second inlet 48 may be situated in the rear face 110 of the cavity as indicated by broken line 118. Similarly, the first inlet 50 may also be provided in the rear face 110 of the cavity 60. Each inlet 48,50 may also be provided in the cover plate 84.

The position of the inlets 48,50 through the casing are dependent upon performance characteristics of the pump such as, for example, rotation speed, air flow rates at the inlet ports, effectiveness of sealing inside the pump. The only condition that must be satisfied is that when the vane 64 exposes inlet port(s) (118 and/or 48) in cavity 60, vacuum must either already be present inside cavity 60 to enable fluid (air or liquid) to be drawn through the port(s) into the cavity, or vacuum created before the next vane rotation closes off that port(s).

The invention has been described with reference to a single sliding vane pump. It will be appreciated that the invention is equally applicable to other types of pump including, for example, multi vane pumps. The pump may be driven either directly or indirectly by a rotatable member of the engine such as, for example the crank shaft or a camshaft. In an alternative embodiment, the pump may be driven electrically. Where the pump is driven electrically, it will be appreciated that it may be operated prior to start up of the vehicle to remove oil accumulated in the turbocharger housing and to prime the brake booster arrangement. By utilising a common pump, the need to provide separate pumps for the brake booster arrangement and to scavenge oil from the turbocharger housing is avoided.

While the above specific embodiment of the invention has been described with reference to a pump for use in conjunction with a brake booster arrangement and to scavenge oil from a turbocharger housing, it will be appreciated that the pump may be arranged to draw oil from other sources in addition to, or alternatively to, a turbocharger. For example as described in the introduction, the pump may be utilised as part of the main engine oil pump circuit when used with a dry sump. The pump could move the oil from the bottom of the engine to a separate storage sump. It will be appreciated that any air sucked up as part of this process does not damage the pump or shorten its life as it is already self lubricating.

As has been described above, the outlet from the pump comprises a pressurised mixture of air and oil. The outlet of the pump may be utilised to distribute the scavenged oil to desired locations in the engine. For example, the outlet may be directed onto the piston rings.

The invention claimed is:

1. A combined gas and liquid pump for an internal combustion engine, the pump including a casing having a cavity containing a rotor and a vane slidably mounted to the rotor, wherein the cavity is provided with first inlet connectable to a gas source, a second inlet connectable to a liquid source separate from the gas source, and an outlet, the rotor and vane being movable to draw gas and liquid into the cavity through the first and second inlets, respectively, and to move said gas and liquid out of the cavity through the outlet, wherein the inlets are arranged through the casing so as to be on opposing sides of the vane at all rotational positions of the vane such that fluid is drawn first through the first inlet and then through the second inlet before being discharged through the outlet, wherein the inlets are arranged such that fluid is drawn in sequence therethrough, and the first inlet is closed before fluid is drawn through the second inlet, and wherein the second inlet has a larger diameter than the first inlet.

2. A pump as claimed in claim 1 wherein one of the inlets is provided with a non-return valve.

3. A pump as claimed in claim 1, wherein both inlets are provided with a non-return valve.

4. A pump as claimed in claim 2, wherein the non-return valve is provided in a conduit member which is fitted to the pump casing and which conduit member is in fluid communication with a cavity inlet.

5. A pump as claimed in claim 1 wherein the rotor is provided with a plurality of slidably mounted vanes.

6. A pump as claimed in claim 1 wherein the cavity has a substantially cylindrical configuration and is defined by a substantially continuous edge wall and opposed end walls.

7. A pump as claimed in claim 6 wherein the edge wall and one of the end walls are defined by the casing, and the other of the end walls is defined by a plate fittable to the casing.

8. A pump as claimed in claim 6 wherein the rotor is mounted in an end wall of the cavity and is offset relative to a center of the cavity.

9. A pump as claimed in claim 1 wherein said gas is air.

10. A pump as claimed in claim 1 wherein said liquid is oil.

11. A vehicle having an engine including an exhaust gas turbocharger and a vacuum operated brake booster, the engine having a combined gas and liquid pump to scavenge oil from the turbocharger and to supply a vacuum to the brake booster, wherein the pump includes a casing having a cavity containing a rotor and a vane slidably mounted to the rotor, and wherein the cavity is provided with first inlet connectable to a lubrication system of the turbocharger, a second inlet connectable to the vehicle brake booster, and an outlet, the rotor and vane being movable to draw oil and air into the cavity through the first and second inlets, respectively, and out of the cavity through the outlet, wherein the inlets are arranged through the casing such that fluid is drawn first through the second inlet and then through the first inlet before being discharged through the outlet, wherein the inlets are arranged so as to be on opposing sides of the vane at all rotational positions of the vane such that the fluid is drawn in sequence therethrough, and the second inlet is closed before fluid is drawn through the first inlet, and wherein the first inlet has a larger diameter than the second inlet.

12. A vehicle as claimed in claim 11 wherein one of the pump inlets is provided with a non-return valve.

13. A vehicle as claimed in claim 11 wherein both of the pump inlets are provided with a non-return valve.

14. A vehicle as claimed in claim 12, wherein the pump non-return valve is provided in a conduit member which is fitted to the pump casing and which conduit member is in fluid communication with a cavity inlet.

15. A vehicle as claimed in claim 11 wherein the pump rotor is provided with a plurality of slidably mounted vanes.

16. A vehicle as claimed in claim 11 wherein the pump cavity has a substantially cylindrical configuration and is defined by a substantially continuous edge wall and opposed end walls.

17. A vehicle as claimed in claim 16 wherein the edge wall and one of the end walls are defined by the casing, and the other of the end walls is defined by a plate fittable to the casing.

18. A vehicle as claimed in claim 16 wherein the rotor is mounted in an end wall of the cavity and is offset relative to a center of the cavity.

* * * * *

UNITED STATES PATENT AND TRADEMARK OFFICE

CERTIFICATE OF CORRECTION

PATENT NO. : 8,651,833 B2
APPLICATION NO. : 12/295704
DATED : February 18, 2014
INVENTOR(S) : David Heaps et al.

It is certified that error appears in the above-identified patent and that said Letters Patent is hereby corrected as shown below:

In the Claims:

Column 7, claim 1, line 2. Specifically, insert --a-- before - first inlet connectable Column 8, claim 11, line 4. Specifically, insert --a-- before - first inlet connectable Signed and Sealed this
Twenty-seventh Day of May, 2014

Michelle K. Lee

Michelle K. Lee
*Deputy Director of the United States Patent and Trademark Office*